US012234732B1

(12) United States Patent
Zhang et al.

(10) Patent No.: US 12,234,732 B1
(45) Date of Patent: Feb. 25, 2025

(54) MONITORING AND WARNING DEVICE FOR ROCK BURST IN COAL MINE

(71) Applicant: Henan Polytechnic University, Jiaozuo (CN)

(72) Inventors: Hongtu Zhang, Jiaozuo (CN); Mian Wang, Jiaozuo (CN); Zhibo Zhang, Jiaozuo (CN); Chao Guo, Jiaozuo (CN); Xiangyang Wang, Jiaozuo (CN); Fenggang Zhang, Jiaozuo (CN); Dong Chen, Jiaozuo (CN); Pan Chen, Jiaozuo (CN); Duzhou Li, Jiaozuo (CN); Liuqun Du, Jiaozuo (CN); Lianbo Huang, Jiaozuo (CN); Jinhua Li, Jiaozuo (CN); Junfang Li, Jiaozuo (CN); He Sun, Jiaozuo (CN); Zhen Li, Jiaozuo (CN); Gongda Wang, Jiaozuo (CN); Xu Chen, Jiaozuo (CN); Weiyong Lu, Jiaozuo (CN)

(73) Assignee: Henan Polytechnic University, Jiaozuo (CN)

( * ) Notice: Subject to any disclaimer, the term of this patent is extended or adjusted under 35 U.S.C. 154(b) by 0 days.

(21) Appl. No.: 18/796,265

(22) Filed: Aug. 6, 2024

(51) Int. Cl.
*E21F 17/18* (2006.01)
*E21B 49/00* (2006.01)

(52) U.S. Cl.
CPC ..... *E21F 17/18* (2013.01); *E21B 49/005* (2013.01); *E21B 49/006* (2013.01)

(58) Field of Classification Search
CPC ..... E21F 17/18; E21B 49/005; E21B 49/006
See application file for complete search history.

(56) References Cited

U.S. PATENT DOCUMENTS 3,577,643 A * 5/1971 Schmidt ..... E21B 47/26 33/544.2

FOREIGN PATENT DOCUMENTS

| | | | |
|---|---|---|---|
| CN | 212805173 | U | 3/2021 |
| CN | 216361020 | U | 4/2022 |
| CN | 115788583 | A | 3/2023 |
| CN | 116085048 | A | 5/2023 |
| CN | 116220816 | A | 6/2023 |

* cited by examiner

*Primary Examiner* — Tarun Sinha

(57) ABSTRACT

The present disclosure provides a monitoring and warning device for rock burst in coal mine, which is configured for monitoring a rock mass in a drill hole, the monitoring and warning device for rock burst in coal mine includes: an integration rod, radial adjustment components, a plurality of bases, and a measuring instrument, the integration rod is extended into the drill hole; the radial adjustment components are provided on the integration rod, and have a plurality of radial adjustment ends; a plurality of bases are correspondingly provided in the radial adjustment ends, and the bases are further connected with attachment components through elastic components, and the attachment components are embedded with first strain gauges; the measuring instrument is rotatably provided in the integration rod, and is used to measure the distance between the measuring instrument and the attachment components.

5 Claims, 4 Drawing Sheets

MONITORING AND WARNING DEVICE FOR ROCK BURST IN COAL MINE

CROSS REFERENCE TO RELATED APPLICATIONS

This application claims foreign priority of Chinese Patent Application No. 202311054497.0, filed on Aug. 22, 2023 in the China National Intellectual Property Administration, the disclosures of all of which are hereby incorporated by reference.

TECHNICAL FIELD

The present disclosure relates to the technical field of rock burst monitoring, and in particular to a monitoring and warning device for rock burst in coal mine.

BACKGROUND

The rock burst in coal mine refers to a dynamic phenomenon in which the coal mass is damaged by the instantaneous release of elastic energy around the tunnel or coal face under the action of high in-situ stress. It belongs to a special manifesting of coal mine dynamic phenomena and is one of the manifestations of mine pressure. Under specific conditions, the rock burst in coal mine will cause the instantaneous deformation and fracture of coal mass, which brings serious threat to the safety production of coal mine. Therefore, monitoring and early warning of the rock burst in coal mine is an important link of coal mine safety management. However, the current monitoring method for rock burst in coal mine is single and can not be adjusted according to the actual situation, and the overall monitoring effect is general.

Accordingly, there is a need to develop a monitoring and warning device for rock burst in coal mine to solve the above problems.

SUMMARY

In order to achieve the above-mentioned object, the present disclosure provides the following technical solutions:

a monitoring and warning device for rock burst in coal mine, which is used for monitoring a rock mass in a drill hole, the monitoring and warning device for rock burst in coal mine includes: an integration rod, radial adjustment components, a plurality of bases, and a measuring instrument, the integration rod is extended into the drill hole;

the radial adjustment components are provided on the integration rod, and have a plurality of radial adjustment ends;

a plurality of bases are correspondingly provided in the radial adjustment ends, and the bases are further connected with attachment components through elastic components, and the attachment components are embedded with first strain gauges;

the measuring instrument is rotatably provided in the integration rod, and is used to measure a distance between the measuring instrument and the attachment components.

Furthermore, as a preferred option, an end of the integration rod is further provided with a drill bit, and the drill bit is used for drilling and extending the drill hole and changing monitoring locations of the attachment components upwards, when a distance change between the measuring instrument and the attachment components exceeds a first threshold.

Furthermore, as a preferred option, an outside of the drill hole is provided with a supporting component; and the supporting component is fixed to the outside of the drill hole through a rock bolt, the supporting component is sealed to and connected to the integration rod; and a bottom of the integration rod is connected to an output end of the power mechanism, a rotation of the integration rod is driven by the power mechanism, the power mechanism is driven by a drilling and driving cylinder to move along an axial direction of the integration rod, and the drilling and driving cylinder is fixed on the supporting component.

Furthermore, as a preferred option, the integration rod are further provided with an upper sealing disc and a lower sealing disc which are symmetrically arranged, and the radial adjustment components and the measuring instrument are located between the upper sealing disc and the lower sealing disc, outer circumferences of both the upper sealing disc and the lower sealing disc are further fixed with collapsible ring capsules.

Furthermore, as a preferred option, the upper sealing disc are further embedded with a second strain gauge, which is used for weighing a quantity of rock debris discharged by the drill bit during each drilling operation, and a monitoring frequency of the measuring instrument is increased when the quantity of rock debris exceeds a second threshold.

Furthermore, as a preferred option, the measuring instrument includes: a rotary ring and a range finder;

an inner side of the rotary ring is rotatably provided with a plurality of rotary wheels, which are used for rotatably providing the rotary ring on the integration rod;

the range finder is fixed on the rotary ring;

and, both an upper end and a lower end of the rotary ring are fixed with sealing rings, which are sealed to and rotatably connected to the integration rod.

Furthermore, as a preferred option, the bases are communicated to the attachment components through corrugated pipes, and the attachment components are defined with the through-holes, the integration rod is a hollow structure with a suction pump and a gas detector inside, and the integration rod is provided with a suction port that is communicated to the hollow structure and located in the rotary ring, and the rotary ring is communicated with a suction duct, which is used for sealing against the bases, and the bases are communicated with communication holes that communicate the corrugated pipes and the suction duct.

Furthermore, as a preferred option, the radial adjustment components include: fixing rings and sliding rings, the fixing rings are fixed on the integration rod, and are hinged with first articulating rods;

the sliding rings are slidably provided on the integration rod, and are hinged with second articulating rods, the radial adjustment ends were formed by the fixing rings and the corresponding adjacent sliding rings, and the radial adjustment ends are used to hinge the bases.

Furthermore, as a preferred option, the attachment components include: deformable plates, bottom plates, and a plurality of connection components; wherein the deformable plates are closed to one side of a hole wall of the drill hole, and the deformable plates are embedded with the first strain gauges;

the bottom plates are connected on the elastic components; and a plurality of connection components are distributed at intervals on the deformable plates and the bottom plates; and intermediate components, which have elasticity, are correspondingly fixed between the connection components on the deformable plates and the connection components on the bottom plates;

the deformable plates and the bottom plates are defined with a plurality of through-holes.

Furthermore, as a preferred option, middle widths of the intermediate components are smaller than widths on both sides of the intermediate components, and the intermediate components and the connection components of the intermediate components at both ends together form an ellipsoidal shape.

Compared with the prior arts, the present disclosure provides a monitoring and warning device for rock burst in coal mine with the following beneficial effects:

1. in some embodiments of the present disclosure, this device is placed in the drill hole to monitor the rock layers, wherein, the mutual cooperation of radial adjustment component and elastic components can make the attachment components tightly adhere to the inner wall of drill hole to ensure the monitoring effect of stress;
2. in some embodiments of the present disclosure, the measuring instrument can further measure the distance change between the measuring instrument and the attachment components, thereby monitoring the movement of rock mass, and the drill bit is used for drilling and extending the drill hole and changing monitoring locations of the attachment components upwards, when the measuring instrument measures that a distance change between the measuring instrument and the attachment components exceeds a first threshold, so as to achieve the monitoring adjustment, thereby further monitoring the depths of drill hole;
3. in some embodiments of the present disclosure, the measuring instrument can further be used in conjunction with the suction pump and the gas detector to achieve the directional monitoring of gas leakage, thereby assisting in the determination of rock burst in coal mine;
4. in some embodiments of the present disclosure, the upper sealing disc are further embedded with a second strain gauge, which is used for weighing a quantity of rock debris discharged by the drill bit during each drilling operation, thereby assisting in the determination of rock burst in coal mine, and a monitoring frequency of the measuring instrument is increased to achieve monitoring and adjustment when the quantity of rock debris exceeds the second threshold.

LABELS AND DESCRIPTIONS

1—integration rod; 2—radial adjustment component; 3—base; 4—elastic component; 5—attachment component; 6—first strain gauge; 7—measuring instrument; 8—drill bit; 9—power mechanism; 10—drilling and driving cylinder; 11—supporting component; 12—rock bolt; 13—upper sealing disc; 14—second strain gauge; 15—corrugated pipe; 16—sealing ring; 17—lower sealing disc; 21—fixing ring; 22—first articulating rod; 23—sliding ring; 24—second articulating rod; 51—deformable plate; 52—bottom plate; 53—intermediate component; 54—connection component; 71—rotary ring; 72—rotary wheel; 73—connection port; 74—suction duct; 101—suction port.

DETAILED DESCRIPTION OF THE EMBODIMENTS

Figure 1:
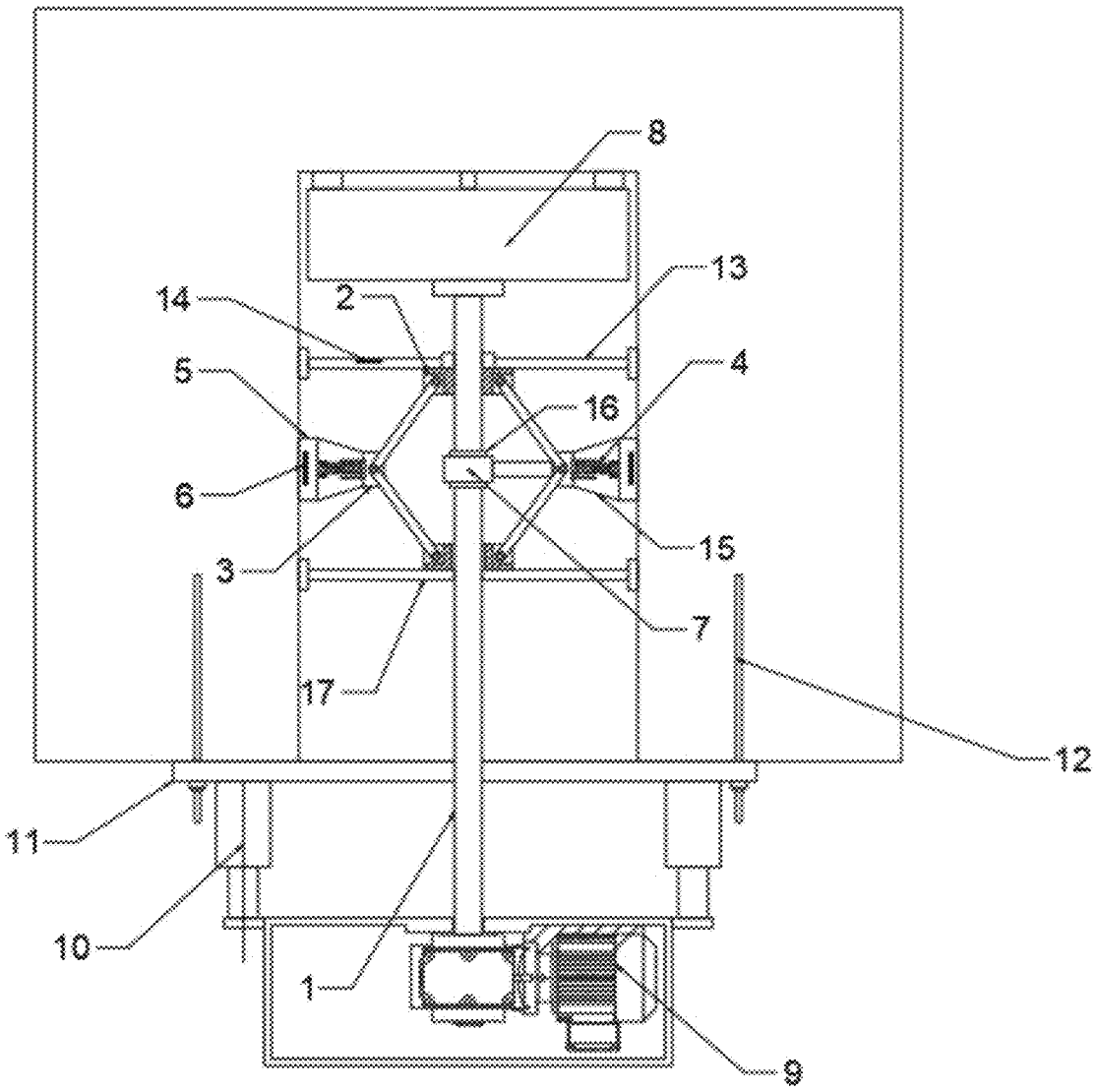
FIG. 1 is a structure schematic diagram of the monitoring and warning device for rock burst in coal mine according to an embodiment of the present disclosure.
Figure 2:
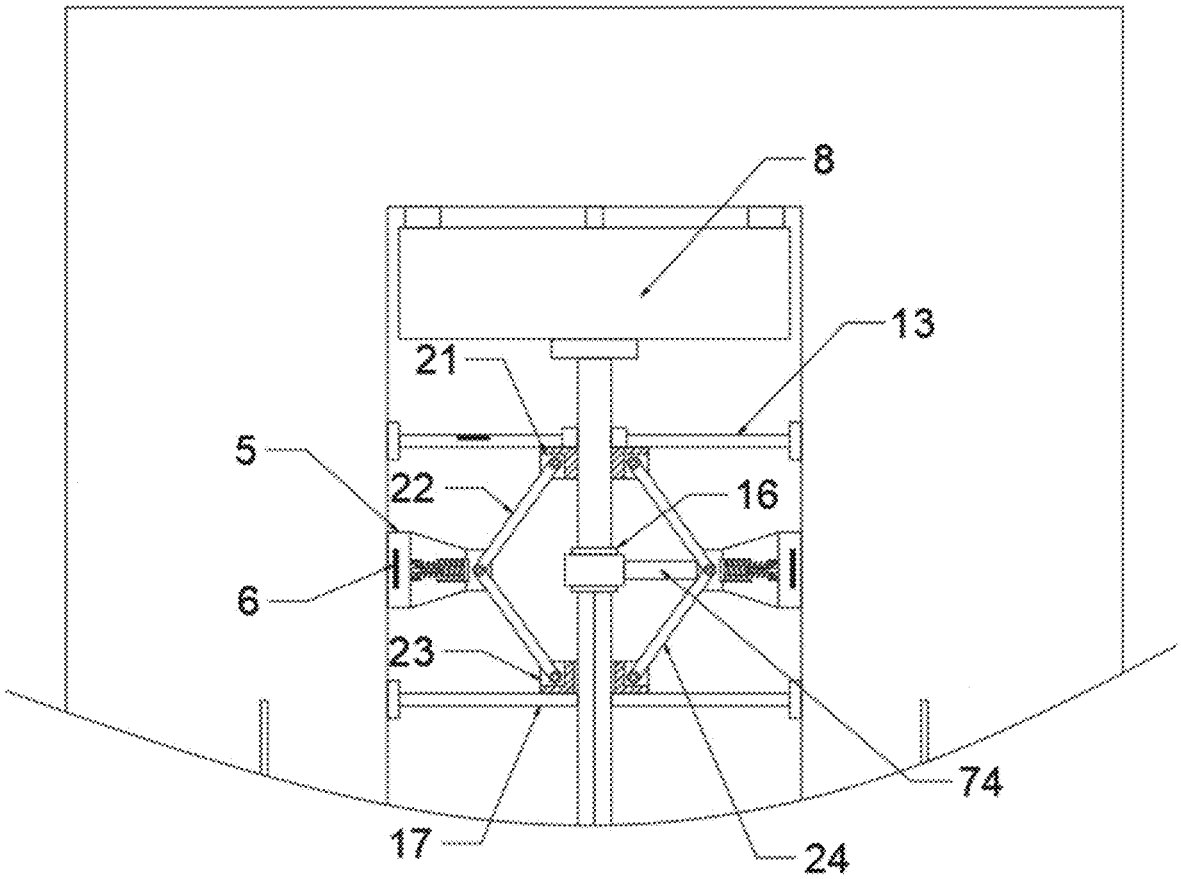
FIG. 2 is a structure schematic diagram of the radial adjustment component in the monitoring and warning device for rock burst in coal mine according to an embodiment of the present disclosure.
Figure 3:
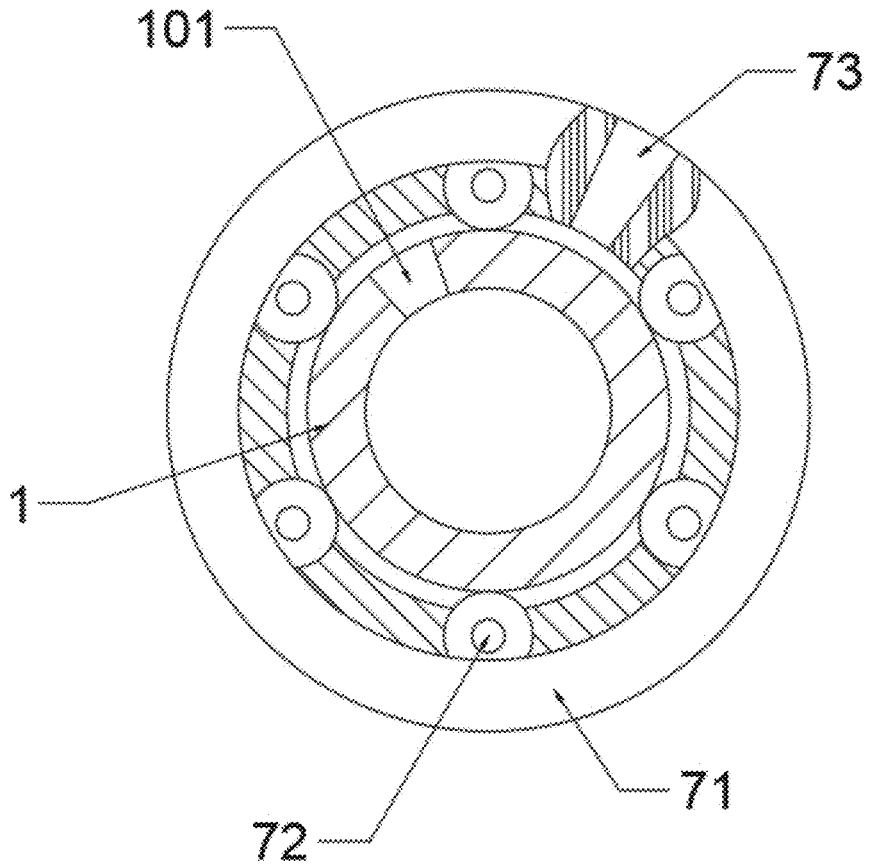
FIG. 3 is a structure schematic diagram of the measuring instrument in the monitoring and warning device for rock burst in coal mine according to an embodiment of the present disclosure.
Figure 4:
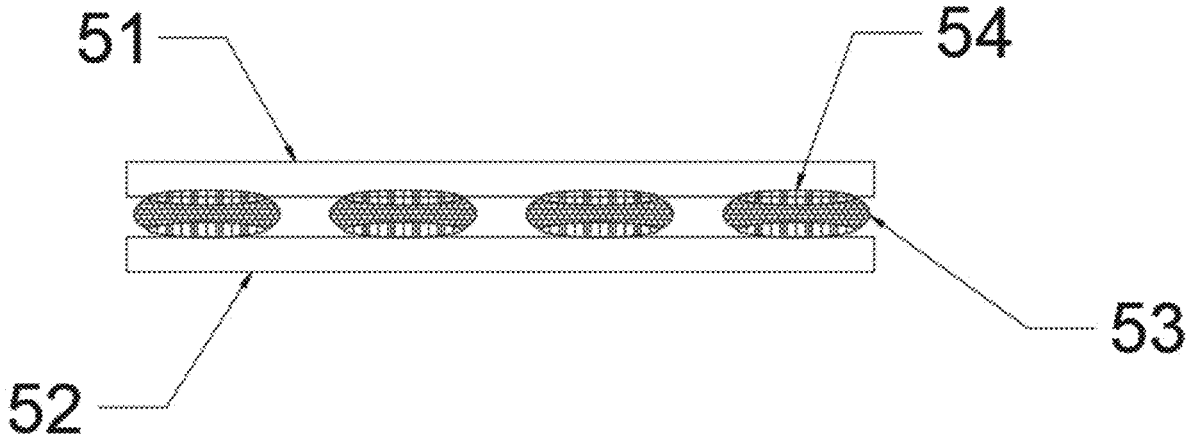
FIG. 4 is a structure schematic diagram of the attachment component in the monitoring and warning device for rock burst in coal mine according to an embodiment of the present disclosure.

As shown in FIGS. 1-4, the example of the present disclosure provides a monitoring and warning device for rock burst in coal mine, which is used for monitoring a rock mass in a drill hole, the monitoring and warning device for rock burst in coal mine includes: an integration rod 1, radial adjustment components 2, a plurality of bases 3, and a measuring instrument 7, the integration rod 1 is extended into the drill hole;

the radial adjustment components 2 are provided on the integration rod 1, and have a plurality of radial adjustment ends;

a plurality of bases 3 are correspondingly provided in the radial adjustment ends, and the bases 3 are further connected with attachment components 5 through elastic components 4, and the attachment components 5 are embedded with first strain gauges 6;

the measuring instrument 7 is rotatably provided in the integration rod 1, and is used to measure a distance between the measuring instrument 7 and the attachment components 5.

This device is placed in the drill hole to monitor the rock layers, wherein, the mutual cooperation of radial adjustment components 2 and elastic components 4 can make the attachment components 5 tightly adhere to the inner wall of drill hole to ensure the monitoring effect of stress;

in some embodiments of the present disclosure, the measuring instrument 7 uses a SW-LDS100DB laser displacement distance measuring sensor, which is an existing device. Specifically, the measuring instrument 7 is provided with a PLC controller inside, the measuring instrument 7 measures the distance between the measuring instrument 7 and the attachment components 5 in real time, and after the distance between the measuring instrument 7 and the attachment components 5 is measured through the measuring instrument 7, by comparing the first measured distance between the PLC controller and the measuring instrument 7 at the corresponding position, the distance change between the measuring instrument 7 and the attachment components 5 is obtained, thereby monitoring the movement of rock mass, so as to assist in the determination of rock burst in coal mine.

In addition, an end of the integration rod 1 is further provided with a drill bit 8, the drill bit 8 is used for drilling and extending the drill hole and changing monitoring locations of the attachment components 5 upwards, when a distance change between the measuring instrument 7 and the attachment components 5 exceeds a first threshold, so as to achieve the monitoring adjustment, thereby further monitoring the depths of drill hole.

During installation, an external drilling rig is firstly used to drill one drill hole, and then the integration rod 1, the radial adjustment components 2 on the integration rod 1, the bases 3, the elastic components 4, the attachment components 5, the measuring instrument 7, the drill bit 8 and the like are placed. Then, the rock bolt 12 is used to fix the supporting component 11, and the drilling and driving cylinder 10 is fixed on the supporting component 11. Finally, the output end of power mechanism 9 is connected to the integration rod 1, and the power mechanism 9 is installed on the drilling and driving cylinder 10.

During the drilling process by using the drill bit 8, the drilling chips are generated. Weighing the drilling chips can assist in determining the rock burst in coal mine. For example, the theoretical weight of drilling chips can be calculated based on the drilling diameter, drilling depth, and rock density of drill bit 8, and the actual weight of drilling chips can be determined by weighing, when the value obtained by subtracting the theoretical weight from the actual weight is large, the warning can be issued;

in order to achieve the drilling action of drill bit 8, an outside of the drill hole is provided with a supporting component 11; the supporting component 11 is fixed to the outside of the drill hole through a rock bolt 12, the supporting component 11 is sealed to and connected to the integration rod 1; and a bottom of the integration rod 1 is connected to an output end of the power mechanism 9, so that the rotation of the integration rod 1 is driven by the power mechanism 9, the power mechanism 9 is driven by a drilling and driving cylinder 10 to move along an axial direction of the integration rod 1, and the drilling and driving cylinder 10 is fixed on the supporting component 11.

In order to achieve the weighing of drilling chips, the integration rod 1 are further provided with an upper sealing disc 13 and a lower sealing disc 17 which are symmetrically arranged, the upper sealing disc 13 are further embedded with a second strain gauge 14, which is used for weighing a quantity of rock debris discharged by the drill bit 8 during each drilling operation, and a monitoring frequency of the measuring instrument 7 is increased when the quantity of rock debris exceeds a second threshold.

In addition, the radial adjustment components 2 and the measuring instrument 7 are located between the upper sealing disc 13 and the lower sealing disc 17, outer circumferences of both the upper sealing disc 13 and the lower sealing disc 17 are further fixed with collapsible ring capsules.

In this example, the measuring instrument 7 includes: a rotary ring 71 and a range finder, an inner side of the rotary ring 71 is rotatably provided with a plurality of rotary wheels 72, which are used for rotatably providing the rotary ring 71 on the integration rod 1;

the range finder is fixed on the rotary ring 71;

and, both an upper end and a lower end of the rotary ring 71 are fixed with sealing rings 16, which are sealed to and rotatably connected to the integration rod 1.

The range finder includes the infrared range finder, the ultrasonic range finder and the like;

in this example, the bases 3 are communicated to the attachment components 5 through corrugated pipes 15, and the attachment components 5 are defined with the through-holes, the integration rod 1 is a hollow structure with a suction pump and a gas detector inside, and the integration rod 1 is provided with a suction port 101 that is communicated to the hollow structure and located in the rotary ring 71; and the rotary ring 71 is communicated with a suction duct 74, which is used for sealing against the bases 3, and the bases 3 are communicated with communication holes that communicate the corrugated pipes 15 and the suction duct 74.

That is to say, in this example, the measuring instrument can further be used in conjunction with the suction pump and the gas detector to achieve the directional monitoring of gas leakage, thereby assisting in the determination of rock burst in coal mine;

In implementation, firstly, the suction duct 74 is moved to a position far away from the bases 3, so as to use the suction pump to suction and discharge the gas between the upper sealing disc 13 and the lower sealing disc 17 to prevent affecting the detection results. Then, the suction duct 73 is moved to one of the corresponding bases 3, the bases 3 are provided with communication holes that communicate the corrugated pipes 15 and the suction duct 74, and the corrugated pipes 15 are further connected to the attachment components 5, the attachment components 5 are defined with the through-holes, so that the targeted suction detection can be achieved.

In this example, the radial adjustment components 2 include: fixing rings 21 and sliding rings 23;

the fixing rings 21 are fixed on the integration rod 1, and are hinged with first articulating rods 22;

the sliding rings 23 are slidably provided on the integration rod 1, and are hinged with second articulating rods 24; and the radial adjustment ends were formed by the fixing rings 21 and the corresponding adjacent sliding rings 23, and the radial adjustment ends are used to hinge the bases 3.

Wherein, the radial adjustment of bases 3 can be achieved through the movement of sliding rings 23. Specifically, when the sliding rings 23 move towards the direction of fixing rings 21, the bases 3 will move towards the direction of hole wall of drill hole, and when the sliding rings 23 move away from the fixing rings 21, the bases 3 move away from the hole wall of drill hole.

In order to enable the sliding of sliding rings 23, the power wheels can be provided on the sliding rings 23, or the telescopic rod and the like can be provided in the bottom of lower sealing disc 17, which will not be further described here.

In this example, the attachment components 5 include: deformable plates 51, bottom plates 52, and a plurality of connection components 54; wherein the deformable plates 51 are closed to one side of a hole wall of the drill hole, and the deformable plates 51 are embedded with the first strain gauges 6;

the bottom plates 52 are connected on the elastic components 4; and a plurality of connection components 54 are distributed at intervals on the deformable plates 51 and the bottom plates 52; and intermediate components 53, which have elasticity, are correspondingly fixed between the connection components on the deformable plates 51 and the connection components on the bottom plates 52;

the deformable plates 51 and the bottom plates 52 are defined with a plurality of through-holes.

On the one hand, the attachment components 5 can be better fitted to the hole wall of drill hole by providing the deformable plates 51, which can achieve the precise monitoring. And, the overall adaptability can be improved by providing the deformables plate 51 and the connection components 54. On the other hand, due to the deformable plates 51 can be better fitted to the hole wall of drill hole, when using the suction duct 74 to suction the gas, it can be suctioned in a smaller range, which can make the suction more directional.

As a preferred example, middle widths of the intermediate components 53 are smaller than widths on both sides of the intermediate components 53, and the intermediate components 53 and the connection components 54 of the intermediate components 53 at both ends together form an ellipsoidal shape.

The foregoing descriptions are merely preferred exemplary embodiments of the present disclosure, but not intended to limit the protection scope of the present disclosure. Within the technical scope disclosed in the present disclosure, any person skilled in the art can make equivalent substitutions or changes according to the technical solution and inventive concept of the present disclosure, which should be included in the scope of protection of the present disclosure.

What is claimed is:

1. A monitoring and warning device for rock burst in coal mine, which is configured for monitoring a rock mass in a drill hole, wherein, comprising: an integration rod, radial adjustment components, a plurality of bases, and a measuring instrument, the integration rod is extended into the drill hole; the radial adjustment components are provided on the integration rod, and have a plurality of radial adjustment ends; a plurality of bases are correspondingly provided in the radial adjustment ends, and the bases are further connected with attachment components through elastic components, and the attachment components are embedded with first strain gauges; the measuring instrument is rotatably provided in the integration rod, and is configured to measure a distance between the measuring instrument and the attachment components; an end of the integration rod is further provided with a drill bit, and the drill bit is configured for drilling and extending the drill hole and changing monitoring locations of the attachment components upwards, when a distance change between the measuring instrument and the attachment components exceeds a first threshold; the integration rod are further provided with an upper sealing disc and a lower sealing disc which are symmetrically arranged, and the radial adjustment components and the measuring instrument are located between the upper sealing disc and the lower sealing disc, outer circumferences of both the upper sealing disc and the lower sealing disc are fixed with collapsible ring capsules; the upper sealing disc are further embedded with a second strain gauge, which is configured for weighing a quantity of rock debris discharged by the drill bit during each drilling operation, and a monitoring frequency of the measuring instrument is increased when the quantity of rock debris exceeds a second threshold; the attachment components comprise: deformable plates, bottom plates, and a plurality of connection components; wherein the deformable plates are closed to one side of a hole wall of the drill hole, and the deformable plates are embedded with the first strain gauges; the bottom plates are connected on the elastic components; and a plurality of connection components are distributed at intervals on the deformable plates and the bottom plates; and intermediate components, which have elasticity, are correspondingly fixed between the connection components on the deformable plates and the connection components on the bottom plates; the deformable plates and the bottom plates are defined with a plurality of through-holes; middle widths of the intermediate components are smaller than widths on both sides of the intermediate components, and the intermediate components and the connection components of the intermediate components at both ends together form an ellipsoidal shape.

2. The monitoring and warning device for rock burst in coal mine according to claim 1, wherein, an outside of the drill hole is provided with a supporting component;

the supporting component is fixed to the outside of the drill hole through a rock bolt, the supporting component is sealed to and connected to the integration rod; and a bottom of the integration rod is connected to an output end of the power mechanism, a rotation of the integration rod is driven by the power mechanism, the power mechanism is driven by a drilling and driving cylinder to move along an axial direction of the integration rod, and the drilling and driving cylinder is fixed on the supporting component.

3. The monitoring and warning device for rock burst in coal mine according to claim 1, wherein, the measuring instrument comprises: a rotary ring and a range finder;

an inner side of the rotary ring is rotatably provided with a plurality of rotary wheels, which are configured for rotatably providing the rotary ring on the integration rod;

the range finder is fixed on the rotary ring;

and, both an upper end and a lower end of the rotary ring are fixed with sealing rings, which are sealed to and rotatably connected to the integration rod.

4. The monitoring and warning device for rock burst in coal mine according to claim 3, wherein, the bases are communicated to the attachment components through corrugated pipes, and the attachment components are defined with the through-holes, the integration rod is a hollow structure with a suction pump and a gas detector inside; and the integration rod is provided with a suction port that is communicated to the hollow structure and located in the rotary ring; and the rotary ring is communicated with a suction duct, which is configured for sealing against the bases, and the bases are communicated with communication holes that communicate the corrugated pipes and the suction duct.

5. The monitoring and warning device for rock burst in coal mine according to claim 1, wherein, the radial adjustment components comprise: fixing rings and sliding rings;

the fixing rings are fixed on the integration rod, and are hinged with first articulating rods; and the radial adjustment ends were formed by the fixing rings and the corresponding adjacent sliding rings, and the radial adjustment ends are configured to hinge the bases.

* * * * *